US007465338B2

(12) United States Patent
Kurasek

(10) Patent No.: US 7,465,338 B2
(45) Date of Patent: Dec. 16, 2008

(54) ELECTROSTATIC AIR-PURIFYING WINDOW SCREEN

(76) Inventor: Christian F. Kurasek, 10 E. Ontario St., #3208, Chicago, IL (US) 60611

( * ) Notice: Subject to any disclaimer, the term of this patent is extended or adjusted under 35 U.S.C. 154(b) by 306 days.

(21) Appl. No.: 11/458,677

(22) Filed: Jul. 19, 2006

(65) Prior Publication Data

US 2007/0034081 A1 Feb. 15, 2007

Related U.S. Application Data

(60) Provisional application No. 60/779,870, filed on Mar. 8, 2006, provisional application No. 60/702,843, filed on Jul. 28, 2005, provisional application No. 60/731,516, filed on Oct. 31, 2005.

(51) Int. Cl.
*B03C 3/68* (2006.01)
*B03C 3/74* (2006.01)

(52) U.S. Cl. ..... 96/25; 95/75; 95/76; 96/46; 96/51; 96/80; 96/96

(58) Field of Classification Search ..... 96/15, 96/25, 46, 51, 80–82, 96, 97; 95/57, 74–76
See application file for complete search history.

(56) References Cited

U.S. PATENT DOCUMENTS

| | | | | |
|---|---|---|---|---|
| 871,652 | A | 11/1907 | Ward | |
| 895,729 | A | 8/1908 | Cottrell | |
| 1,120,561 | A | 12/1914 | Strong et al. | |
| 1,358,031 | A | 11/1920 | Smith | |
| 1,358,032 | A | 11/1920 | Smith | |
| 1,396,811 | A | 11/1921 | Chubb | |
| 1,409,901 | A | 3/1922 | Anderson | |
| 1,787,955 | A | 1/1931 | Rosecrans | |
| 1,865,907 | A | 7/1932 | Heinrich | |
| 1,878,024 | A | 9/1932 | Strigel | |
| 1,934,923 | A | 11/1933 | Heinrich | |
| 1,957,458 | A | 5/1934 | Horne et al. | |
| 1,976,214 | A | 10/1934 | Brion et al. | |
| 2,000,020 | A | 5/1935 | Heinrich | |
| 2,000,654 | A | 5/1935 | Wintermute | |
| 2,008,246 | A | 7/1935 | Deutsch | |
| 2,049,561 | A | 8/1936 | Graves | |
| 2,069,692 | A | 2/1937 | Wintermute | |
| 2,086,063 | A | 7/1937 | Brion et al. | |
| 2,188,695 | A | 1/1940 | Wintermute | |
| 2,251,451 | A | 8/1941 | Heinrich | |
| 2,295,152 | A | 9/1942 | Bennett | |
| 2,440,455 | A | 4/1948 | White | |
| 2,462,890 | A | 3/1949 | Newman | |
| 2,504,858 | A | 4/1950 | MacKenzie | |
| 2,578,558 | A | 12/1951 | Klemperer | |
| 2,861,648 | A | 11/1958 | Fields | |
| 3,040,497 | A | 6/1962 | Schwab | |
| 3,159,471 | A * | 12/1964 | Revell | 96/46 |
| 3,485,011 | A | 12/1969 | Archer et al. | |
| 3,496,701 | A | 2/1970 | Berg | |
| 3,540,191 | A * | 11/1970 | Herman | 96/51 |

(Continued)

*Primary Examiner*—Richard L Chiesa

(57) ABSTRACT

A window screen apparatus employing electrostatic principles to purify air. The window screen mesh wires encompass electrically-conductive filaments that are charged by a high-voltage DC pulse generator. Between and surrounding the wires an electric field is created that charges, traps, and repels airborne particulate. An alternative embodiment consists of a window screen in which the screen mesh wires are manufactured from permanently electrostatically charged fibers.

14 Claims, 11 Drawing Sheets

U.S. PATENT DOCUMENTS 3,577,708 A 5/1971 Drenning et al.
3,581,462 A 6/1971 Stump
3,633,337 A 1/1972 Walker et al.
3,665,679 A 5/1972 McLain et al.
3,719,031 A 3/1973 Gelfand
3,727,380 A 4/1973 Remick
3,739,552 A 6/1973 Webster et al.
3,739,554 A 6/1973 Whetten
3,740,927 A 6/1973 Vincent
3,747,299 A 7/1973 Chiang
3,778,970 A 12/1973 Swimmer et al.
3,803,808 A 4/1974 Shibuya et al.
3,820,306 A 6/1974 Vincent
3,907,520 A 9/1975 Huang et al.
3,915,672 A 10/1975 Penney
3,917,470 A 11/1975 Xmris et al.
3,924,547 A 12/1975 Werner
3,930,815 A 1/1976 Masuda
3,933,643 A 1/1976 Colvin et al.
3,981,695 A 9/1976 Fuchs
3,984,215 A 10/1976 Zucker
3,985,525 A 10/1976 Tomaides
3,999,964 A 12/1976 Carr
4,029,482 A 6/1977 Postma et al.
4,049,400 A 9/1977 Bennett
4,072,477 A 2/1978 Hanson et al.
4,089,661 A 5/1978 Milum
4,094,653 A 6/1978 Masuda
4,119,416 A 10/1978 Hayashi et al.
4,126,434 A 11/1978 Keiihi
4,133,649 A 1/1979 Milde
4,162,144 A 7/1979 Cheney
4,177,046 A 12/1979 Moriyama
4,193,774 A 3/1980 Pilat
4,194,888 A 3/1980 Schwab et al.
4,203,948 A 5/1980 Brundbjerg
4,209,306 A 6/1980 Feldman et al.
4,222,748 A 9/1980 Argo et al.
4,231,766 A 11/1980 Spurgin
4,240,809 A * 12/1980 Elsbernd et al. ..... 96/46
4,244,709 A 1/1981 Chang
4,251,234 A 2/1981 Chang
4,259,093 A 3/1981 Vlastos et al.
4,259,707 A 3/1981 Penney
4,265,641 A 5/1981 Natarajan
4,289,504 A 9/1981 Scholes
4,342,571 A 8/1982 Hayashi
4,351,648 A 9/1982 Penney
4,391,773 A 7/1983 Flanagan
4,412,850 A 11/1983 Kurata et al.
4,481,017 A 11/1984 Furlong
4,496,375 A 1/1985 Le Valentine
4,523,463 A 6/1985 Fathauer et al.
4,534,776 A 8/1985 Mammel et al.
4,569,684 A 2/1986 Ibbott
4,643,745 A 2/1987 Sakakibara et al.
4,673,416 A 6/1987 Sakakibara et al.
4,675,029 A 6/1987 Normal et al.
4,689,056 A 8/1987 Noguchi et al.
4,713,092 A 12/1987 Kikuchi et al.
4,715,870 A 12/1987 Masuda et al.
4,725,289 A 2/1988 Quintilian
4,726,812 A 2/1988 Hirth
4,765,803 A 8/1988 Hirth
4,778,493 A 10/1988 Fitch et al.
4,789,801 A 12/1988 Lee
4,822,381 A 4/1989 Mosley et al.
4,861,356 A 8/1989 Penney
4,877,427 A 10/1989 Smith
4,976,749 A 12/1990 Adamski et al.
4,987,839 A 1/1991 Krigmont et al.
5,005,101 A 4/1991 Gallagher et al.
5,037,456 A 8/1991 Yu
5,059,218 A * 10/1991 Pick ..... 96/66
5,059,219 A 10/1991 Plaks et al.
5,084,077 A 1/1992 Junker et al.
5,163,983 A 11/1992 Lee
5,199,257 A 4/1993 Colletta et al.
5,215,558 A 6/1993 Moon
5,221,297 A * 6/1993 Childress et al. ..... 95/75
5,290,343 A 3/1994 Morita et al.
5,302,190 A 4/1994 Williams
5,330,559 A 7/1994 Cheney et al.
5,437,713 A * 8/1995 Chang ..... 96/51
5,466,279 A 11/1995 Hattori et al.
5,484,472 A 1/1996 Weinberg
5,492,677 A 2/1996 Yoshikawa
5,547,493 A 8/1996 Krigmont
5,547,496 A 8/1996 Hara
5,587,005 A 12/1996 De Marco
5,591,249 A 1/1997 Hankins
5,593,560 A 1/1997 Inoue
5,601,633 A 2/1997 Ponizovsky et al.
5,601,791 A 2/1997 Plaks et al.
5,603,752 A 2/1997 Hara
5,656,063 A 8/1997 Hsu
5,669,963 A 9/1997 Horton et al.
5,695,549 A 12/1997 Feldman et al.
5,707,428 A 1/1998 Feldman et al.
5,846,302 A 12/1998 Putro
5,961,693 A 10/1999 Altman et al.
5,980,614 A 11/1999 Loreth et al.
5,993,521 A 11/1999 Loreth et al.
6,004,376 A 12/1999 Frank
6,063,168 A 5/2000 Nichols et al.
6,090,189 A 7/2000 Wikstrom et al.
6,117,216 A 9/2000 Loreth
6,126,722 A * 10/2000 Mitchell et al. ..... 95/57
6,224,653 B1 5/2001 Shvedchikov et al.
6,251,171 B1 6/2001 Marra et al.
6,312,507 B1 11/2001 Taylor et al.
6,375,714 B1 * 4/2002 Rump et al. ..... 95/3
6,454,839 B1 9/2002 Hagglund et al.
6,494,934 B2 * 12/2002 Fukushima ..... 95/63
6,508,861 B1 1/2003 Ray
6,589,314 B1 7/2003 Page et al.
6,602,330 B2 8/2003 Allen
6,635,106 B2 10/2003 Katou et al.
6,679,940 B1 * 1/2004 Oda ..... 96/55
6,730,141 B2 5/2004 Goebel et al.
6,758,884 B2 7/2004 Zhang et al.
6,761,752 B2 7/2004 Fissan et al.
6,773,489 B2 8/2004 Dunn
6,790,259 B2 9/2004 Rittri et al.
6,852,149 B2 2/2005 Huang
6,872,238 B1 3/2005 Truce
6,878,192 B2 4/2005 Pasic
6,902,604 B2 6/2005 Heckel et al.
6,926,758 B2 8/2005 Truce
6,955,708 B1 * 10/2005 Julos et al. ..... 95/59
6,986,803 B1 1/2006 Richards
7,019,244 B2 3/2006 Weaver et al.
7,063,820 B2 * 6/2006 Goswami ..... 422/186.3
7,182,805 B2 * 2/2007 Reaves ..... 96/24
2004/0251122 A1 * 12/2004 Goswami ..... 204/157.3

* cited by examiner

ELECTROSTATIC AIR-PURIFYING WINDOW SCREEN

CROSS-REFERENCE TO RELATED APPLICATION

This application claims priority of Kurasek U.S. provisional applications Ser. No. 60/779,870 filed on Mar. 8, 2006, entitled "Air purifying electrostatic window screen apparatus", No. 60/702,843 filed on Jul. 28, 2005, entitled "Air purifying ionic window screen apparatus", and No. 60/731,516 filed on Oct. 31, 2005, entitled "Electrostatic air-purifying window screen apparatus" the contents of which are expressly incorporated herein by reference in their entirety including the contents and teachings of any references contained therein.

FIELD OF THE INVENTION

The present invention generally relates to utilizing electrostatic air-purification methods in a window screen embodiment to substantially reduce the amount of airborne particulate passing through and in the vicinity of the invention, which is mounted in a building window frame.

BACKGROUND OF THE INVENTION

Window screens in the present art serve as physical barriers to prevent insects and other foreign matter that exceed the size of the gaps between the screen wires from passing through the window frame in which the screen is installed. The limitation of traditional window screens is their ineffectiveness against particulate suspended in the air that are smaller than the size of the gaps between the screen wires. Traditional window screens are generally ineffective against dust, pollen, mold spores, bacteria, and other allergens, dirt, and pollution suspended in air that are small enough to pass through the screens.

Specialty window screen replacements designed to filter out the aforementioned air contaminates exist, but designs in the current art do not allow for the passage of air as quickly or freely as traditional window screens, and/or are opaque, preventing or reducing the ability to see through the window frame in which the screen replacement is mounted. Many of the current art designs are simply fibrous filters, such as HEPA filters, that serve as physical barriers to airborne particulate. Such filters allow for a window to be opened only a fraction of the way, limiting the amount of air that can pass through the window frame and preventing or reducing the ability of a person to see through the portion of the window frame area occupied by the filter.

Indoor air purifiers utilizing electrostatic principles are known in the current art, but existing designs are specific to removing contaminants suspended in indoor air by circulating and processing the air. Popular commercially available electrostatic air purifiers are stand-alone units designed to be placed inside of a building and work by mechanically or electro-kinetically moving air over electrically-charged electrodes that ionize and trap airborne particulate.

Additionally, there are industrial electrostatic purifiers designed to be installed in the airflow of building heating, ventilating, and air-conditioning (HVAC) systems that ionize and trap airborne particulate as air is moved through the HVAC system. Similarly, there are also technologies in the current art that are designed to electrostatically remove airborne particulate in large-scale industrial settings, such as factory smokestack scrubbers and other exhaust outlets. Existing designs predominately consist of multiple planar wire mesh screens mounted in airflow pathways (such as smoke stacks or ventilation ducts) substantially parallel to each other and charged to high voltage electric potentials.

A limitation of indoor electrostatic air purifiers in the existing art is that they are designed only to reduce the amount of airborne contaminate already in a building, they do nothing to prevent airborne contaminants from entering a building. In the case of the industrial air purifiers, they are generally designed to reduce the amount of airborne particulate exiting a building via exhaust gasses. There is no technology in the current art that is designed to minimize or reduce the amount of contaminant entering a building through building windows by employing electrostatic air-purification principles.

SUMMARY OF THE INVENTION

The present invention is a window screen apparatus that utilizes electrostatic properties to purify the air passing through or in the vicinity of the apparatus. The apparatus resembles a standard window screen, consisting of a wire mesh screen mounted in a frame designed to fit and latch into the window frame for which the apparatus is designed to be placed. The wire mesh is constructed from electrically conductive filaments, which are coated in and insulated by a non-electrically conductive, flexible material, possibly nylon or a similar polymer.

The electrically-conductive filaments are charged by a high-voltage (possibly 15 kV), low-amperage DC pulse generator that is powered by DC current, supplied by a DC battery or an AC-DC converter.

The conductive wire mesh filaments are connected to the pulse generator's electric potentials via two electrically-conductive, electrically-insulated tracks that run the perimeter of the apparatus frame.

Additionally, the apparatus contains a cleaning mechanism that automatically physically dislodges particulate that accumulates on the wire mesh screen.

BRIEF DESCRIPTION OF THE DRAWINGS

While the claims set forth the features of the present invention with particularity, the invention, together with its objects and advantages, may be best understood from the following detailed description taken in conjunction with the accompanying drawing of which:

DETAILED DESCRIPTION OF THE DRAWINGS

The present invention provides a means for substantially reducing the amount of airborne particulate passing through a window screen by employing electrostatic principles to repel and remove particulate that is suspended in the air passing through a window screen. Additionally, the invention may trap airborne particulate that is contained in the air already inside of a building employing the invention, i.e. the invention may remove particulate from air in the vicinity of the invention, the air does not necessarily need to be passing through the screen for air purification to occur.

Figure 1:
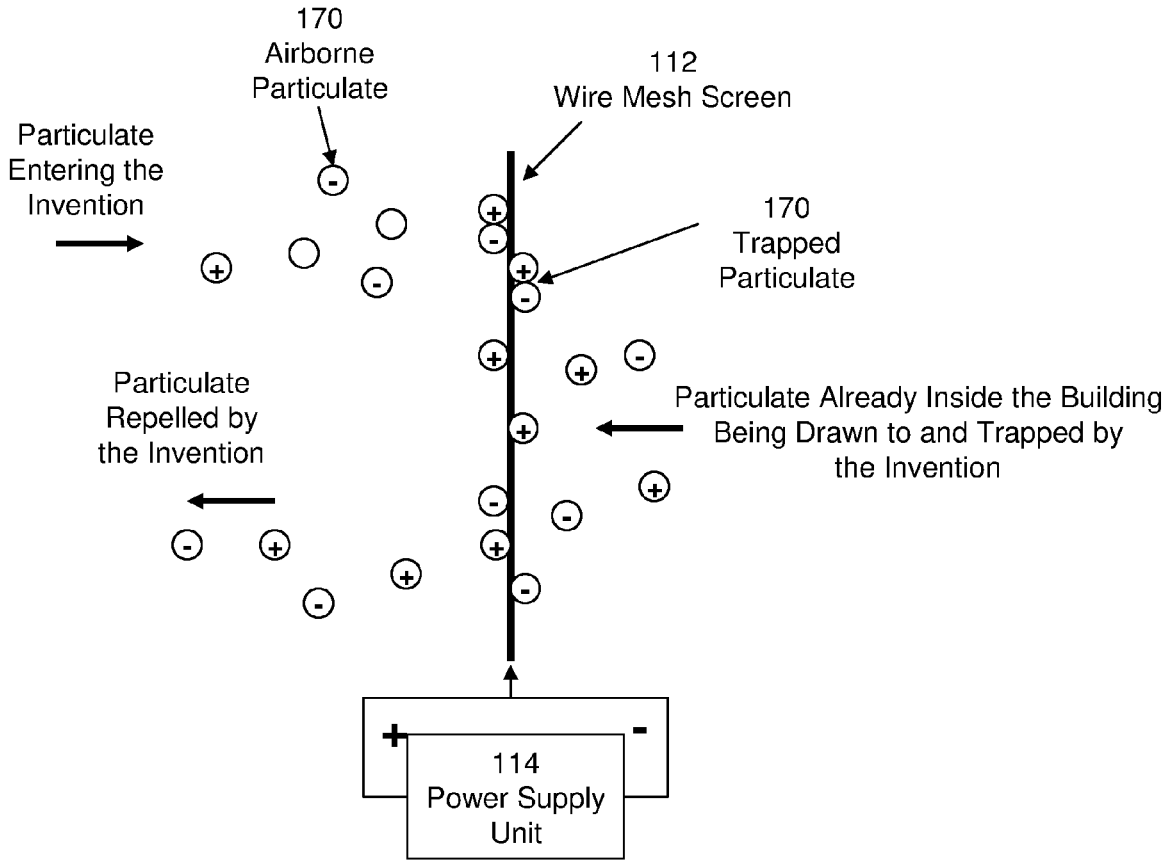
FIG. 1 is a functional view of the invention in operation.

As depicted in FIG. 1, the invention utilizes the electrostatic properties of an electric field created by electrically-charging a wire screen mesh 112 contained within a window screen apparatus to trap and repel airborne particulate 170.

Figure 2:
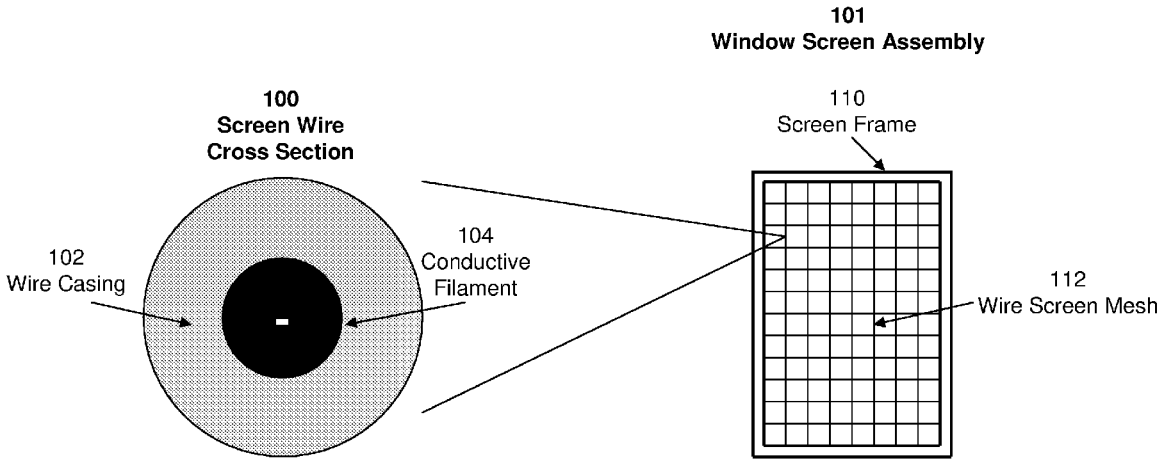
FIG. 2 is a plan view of the invention with a cross-section perspective view of the screen wire.

The electrostatic window screen apparatus depicted in FIG. 2 externally resembles a traditional window screen in that it primarily consists of a wire mesh screen 112 affixed to a screen frame 110 that is designed to be mounted in building window frame 125. The screen frame may be constructed from a lightweight metal (e.g. aluminum) or rigid, durable polymer (e.g. HDPE) or composite (e.g. carbon fiber) and is quadrangular in shape.

Standard clasps or latches for securing the invention frame in a window frame 125 may be utilized depending on the type of window frame interface required. The screen frame may also be designed to simply sit in a window frame 125 without a mechanical latching-type affixment, where the frame is held in place solely through friction.

The wire casing 102 used to create the wire 100 used in the construction of the mesh screen 112 is made from a strong, flexible, and non-electrically conductive material such as nylon. Contained within the screen mesh wire 100 is an electrically-conductive filament 104 that is electrically insulated from open air.

The screen wire 100 may be oblique in shape to enable spatial orientation control during the manufacture of the screen mesh 112 and the assembly of the invention. The wire 100 may also be a flat ribbon (where the width of the wire is substantially greater than the thickness of the wire, which is in more of a rectangular shape as opposed to an elliptical shape) to similarly enable spatial orientation control.

Figure 3:
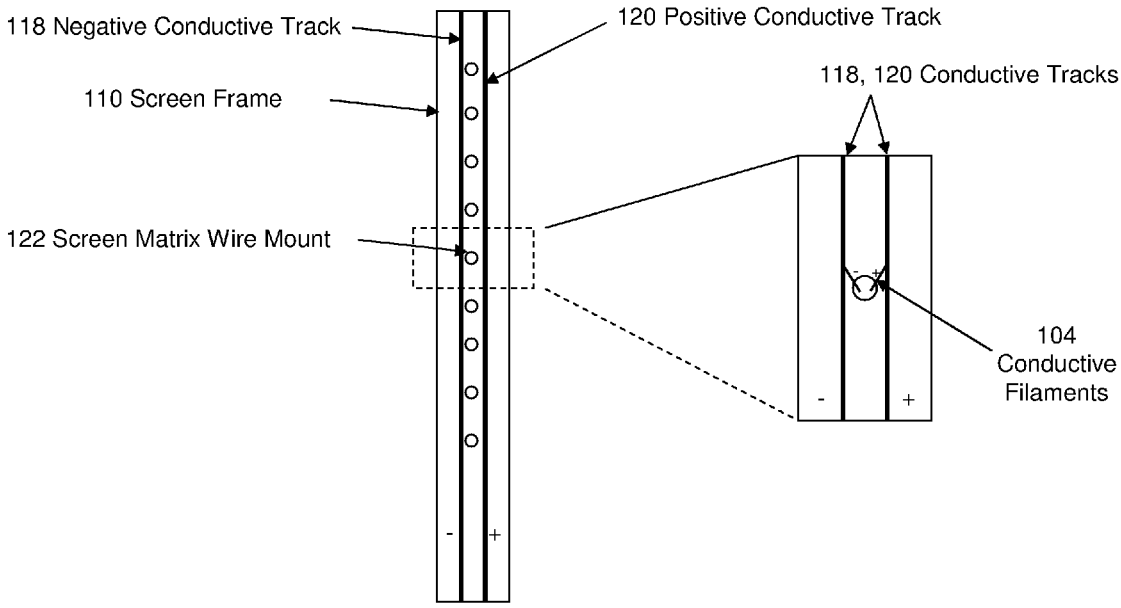
FIG. 3 is a plan view of one method for connecting the screen wire filaments to the electric potentials.

As depicted in FIG. 3, the wire filaments 104 may be connected to the electric potential, by being physically connected, possibly by soldering or clamping, to one of the two conductive tracks 118, 120 that run the perimeter of the screen frame 110. The conductive tracks 118, 120 are electrically insulated from each other and the rest of the screen frame 110. One conductive track 120 is connected to the positive output electrode 124 of the power supply unit 114. Similarly, the other conductive track 118 connected to the negative output electrode 124 of the power supply unit 114 (seen in FIG. 6*a*).

Figure 4A:
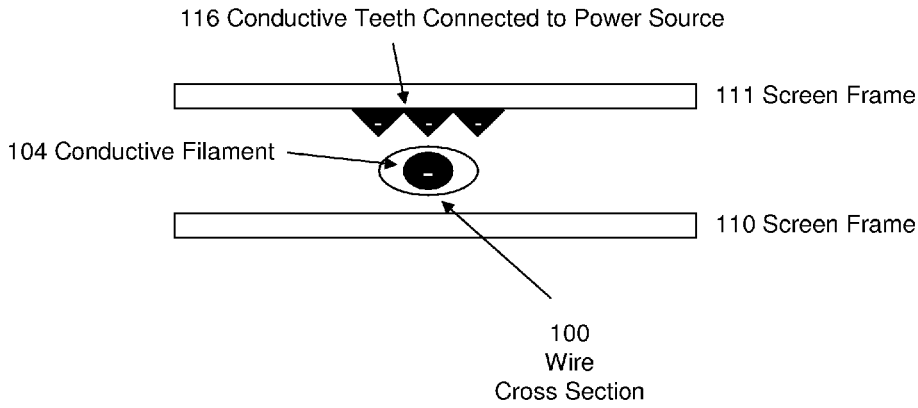
FIG. 4*a* is a plan view prior to assembly of another method for connecting the screen wire filaments to the electric potentials.
Figure 4B:
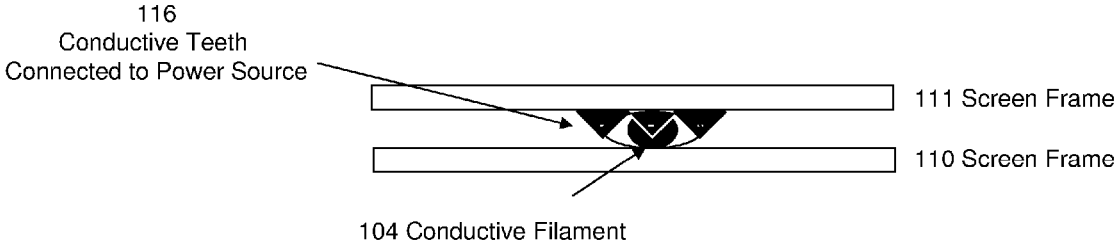
FIG. 4*b* is a plan view of the post-condition for the method of FIG. 4*a*.
Figure 5A:
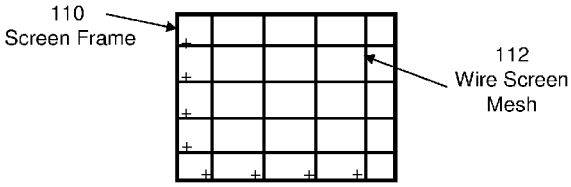
FIG. 5*a* is functional view of one possible charge pattern for the screen mesh wires.
Figure 5B:
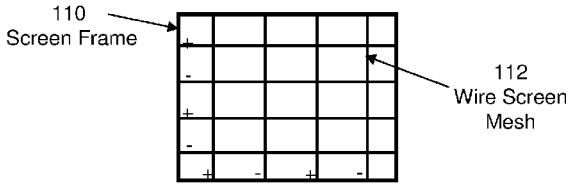
FIG. 5*b* is functional view of another possible charge pattern for the screen mesh wires
Figure 5C:
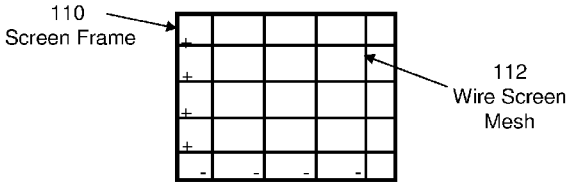
FIG. 5*c* is functional view of another possible charge pattern for the screen mesh wires

FIG. 4*a* depicts another method for connecting the conductive filaments 104 to the electric potentials through the use of conductive teeth 116 embedded in the screen frame 110. The frame may be constructed from two discrete, rectangular frames 110, 111 that are designed to mate together. At each wire segment terminal point (where the screen wire is affixed to the frame 122 in FIG. 3), one of the frame halves 111 in FIG. 4*a* contains a set of rigid, electrically conductive teeth—small, rectangular protrusions mounted perpendicular to the frame 111. With the screen wires 100 mounted to the second frame half 110, the two frames are mated as seen in FIG. 4*b*. The conductive teeth 116 penetrate the screen wire 100 to come in physical contact with the conductive filament 104 contained within the wire. A similar method would be similar to the conductive teeth 116, only using conductive cylindrical pins in place of the teeth. Yet another similar method would be for the triangular conductive teeth 116 to be replaced by semicircular, sharpened teeth that instead of puncturing the wires at a single point would encompass and clamp down on a half-diameter of the wire There are several charge patterns possible for the screen mesh wires, as shown in FIGS. 5*a*, 5*b*, and 5*c*. FIG. 5*a* represents a configuration in which all of the filaments in the wire screen mesh 112 are charged to the same polarity. While the easiest implementation, this configuration is the least effective—it will only be effective in trapping and repelling particulate that already possess an electric charge. The configuration may convey a charge to particulate passing though the wire screen mesh 112, but in that occurrence the invention will not be removing the particulate from the air.

A second charge pattern possibility is to alternate the polarity of successive wires such that every wire in a given plane of the mesh has wires of opposite polarities neighboring it, as seen in FIG. 5*b*. Every wire in the vertical plane is the opposite polarity of the wire directly above and below it. The wires are charged in a positive-negative-positive-negative pattern.

A third charge pattern possibility is to charge all of the wires strung in one plane (e.g. the vertical plane) to one polarity, while charging all of the wires strung in the other plane (e.g. the horizontal plane) to the opposite polarity, as seen in FIG. 5*c*.

The distance between the screen wire filaments 104 should be optimized to generate the largest and most powerful electric field possible given the screen wire diameter and the voltage produced by the power supply unit 114. However, the size of the gaps between the screen wires (possibly 1 mm to 3 mm) and the gauge of the screen wires themselves (possibly 0.2 mm to 1 mm) should remain close to the standards of traditional window screens to retain the traditional window screen's physical barrier and transparency properties.

The high-voltage pulses create an electric field between and surrounding the filaments 104 that will either attract or repel electrically-charged particulate 170 that is suspended in the air surrounding and passing through the window screen 112. Additionally, the electric field may charge neutral particulate 170 that enters the field. These newly charged particles will then either be repelled by the screen's 112 electric field or become trapped within it.

Figure 6A:
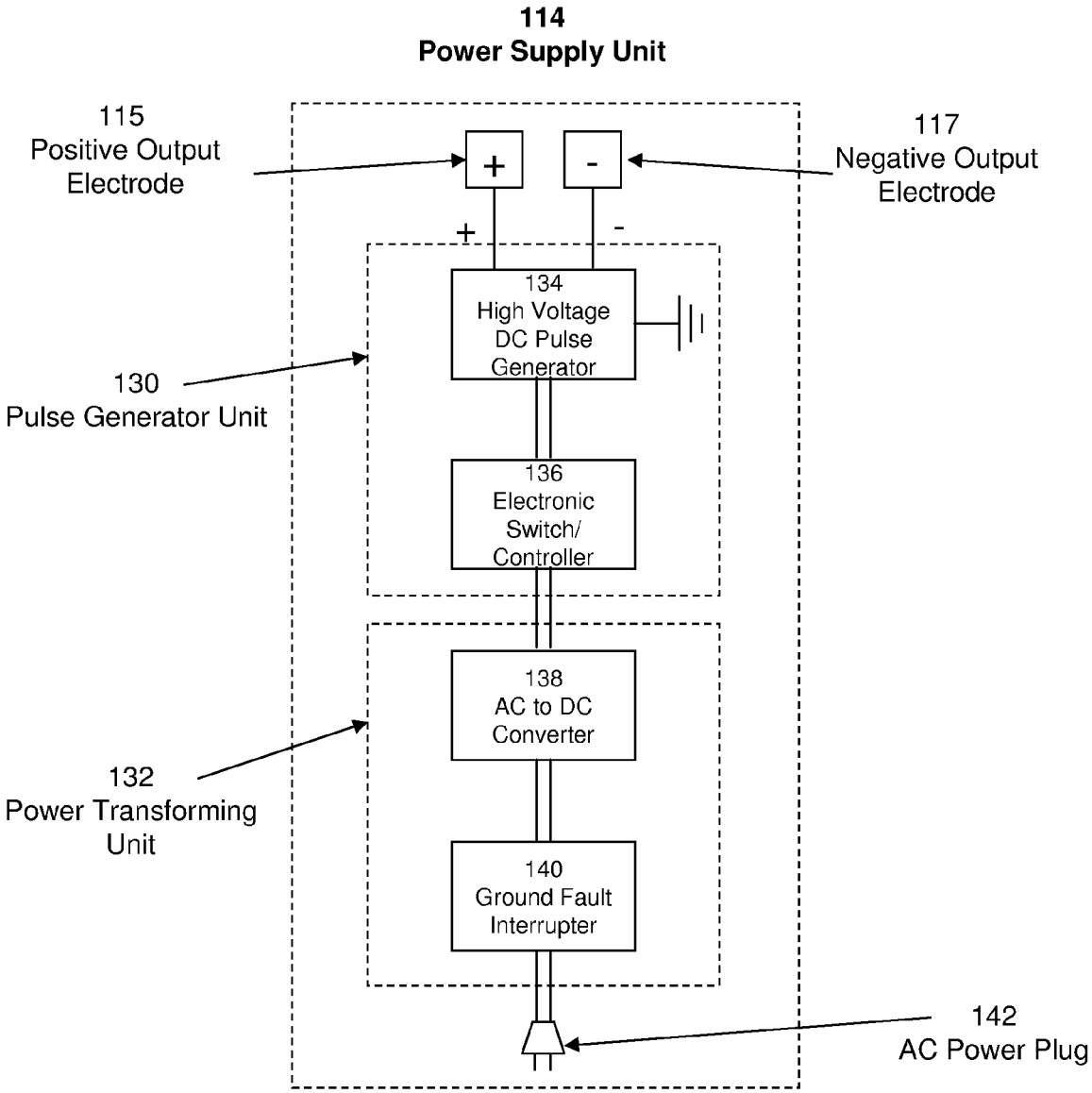
FIG. 6*a* is a block diagram for the alternating current-powered embodiment of the invention's power supply unit.

Either internally to the invention (contained within or mounted on to the frame of the invention, as seen in FIG. 2) or externally to the invention, there exists an electric power supply unit 114 that contains a high-voltage DC pulse generator 134 as seen in FIG. 6*a* that provides high-voltage pulses of possibly 15 kV peak-to-peak, although an essentially 100% duty cycle output could be substituted for the pulses. The pulse generator 134 preferably generates the high-voltage pulses at very low amperage (1 mA or less) for safety reasons. Pulse generators 134 that satisfy the aforementioned design requirements are commercially available—one such pulse generator is the 12 VDC (15 kV Output) Negative Ion Generator available from Electronic Goldmine (http://www.goldmine-elec.com).

The high voltage pulse generator 134 and the electronic switch/controller 136 together compromise the pulse generator unit 130. The pulse generator unit 130 is connected to the output electrodes 115, 117 that are connected to the filaments' 104 electric potentials.

Figure 6B:
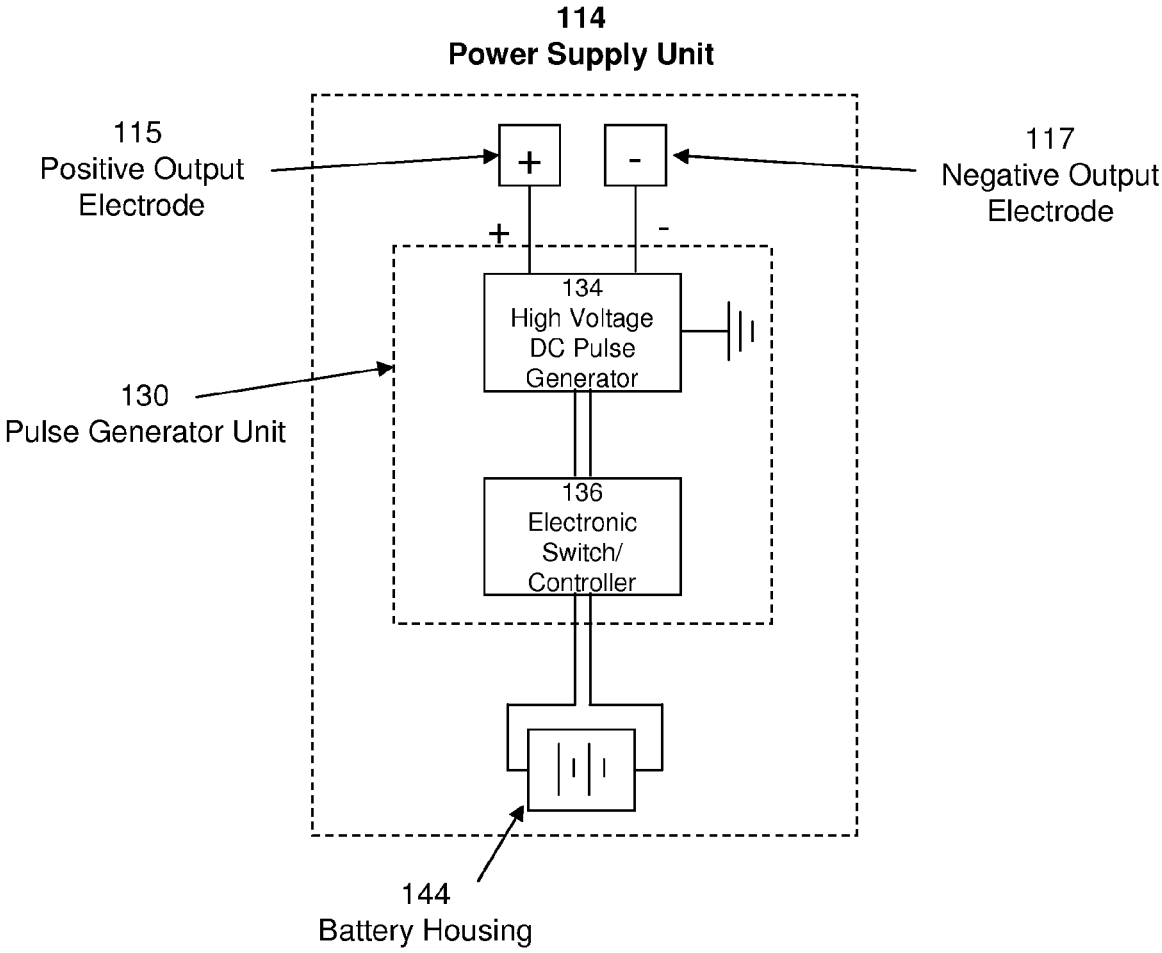
FIG. 6*b* is a block diagram for the battery-powered embodiment of the invention's power supply unit.

The power supply unit 114 may have electricity supplied by standard building electrical wiring as seen in FIG. 6*a* (at 110 VAC in the US), or may have electricity supplied by a battery, as seen in FIG. 6*b*.

In the instance of the AC-powered configuration (FIG. 6*a*), the power supply unit 114 is connected to the building AC power source in series with a Ground Fault Interrupter Circuit ("GFIC") 140. The GFIC 140 will open the circuit between the power supply unit 114 and the building wiring when a change in current/impedance is detected, indicating a short circuit has occurred. The GFIC 140 will not restore power to the AC-DC converter 138 until the short circuit has been removed. GFIC 140 circuits suitable to the requirements of the invention are commercially available.

In the instance of the battery-powered power supply unit, depicted in FIG. 6*b*, the power supply unit 114 is mounted on or within the invention frame 110. Additionally, there is a battery housing 144 to secure and electrically connect the battery/batteries to the pulse generator unit 130.

Figure 7:
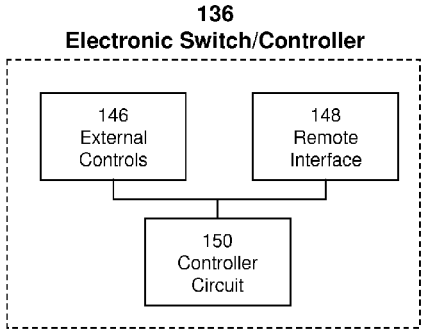
FIG. 7 is a block diagram of the invention's power switch and programmable controller configuration.
Figure 8:
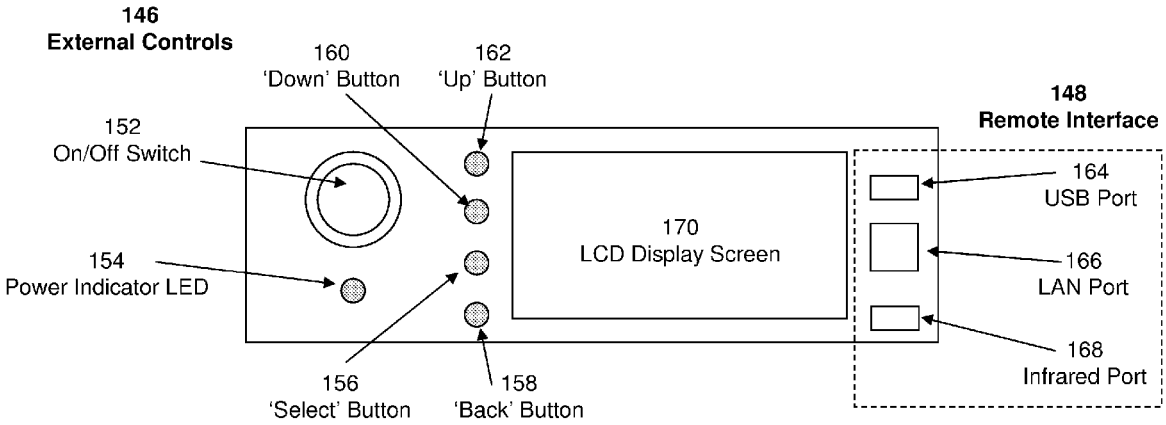
FIG. 8 is a plan perspective view of the invention's external control panel.

The pulse generator 134 is connected in series with an electronic switch/controller 136 that controls the operation of the generator. The electronic switch/controller 136 consists of three primary components, as seen in FIG. 7. The external controls 146 component consists of an electronic control panel mounted to/within the invention frame 110 or window frame 125, detailed in FIG. 8.

The external control panel consists of an on/off switch 152, an LED indicator 154 the indicates whether the invention is turned on, menu control buttons consisting of an 'up' button 162 that controls the upwards movement of options in control menus, a 'down' button 160 that controls the downwards movement of options in control menus, a 'select' button 156 that selects chosen menu options, and a 'back' button 158 that controls the return to previous control menus. Schedule programming of the invention is accomplished via the menu control buttons and the LCD display screen 170 that displays the user interface.

The external controls 146 also consist of the external ports for the remote interface 148 which enables remote control and programming of the invention. The external ports may consist of a USB port 164 to connect directly to an electronic device, such as a PC, a LAN port 166 that may connect the invention to a LAN or the Internet, and an infrared port 168 that is a receptor for a remote control device, similar to a standard television remote control, designed to be used in the immediate vicinity of the invention.

Both the external controls 146 and the remote interface 148 are connected to the controller circuit 150 that enables programming of the invention. The controller circuit 150 contains scheduling logic that enables a user to program the operation of the invention on a time and day schedule.

The power supply unit 114 may be controlled by a manual on/off switch 152. Additionally, the power supply unit 114 may be connected to a programmable logic controller circuit 150 that enables remote control of the power source by utilizing technology such as infrared, Bluetooth, radio frequency, etc. The programmable logic controller circuit 150 may also be connected to a remote interface 148, including but not limited to a USB, LAN, WLAN, serial, or parallel port, that enables controlling the power supply unit 114 via an electronic device, such as a PC connected to a home network or via the Internet.

The programmable logic controller circuit 150 may also be controlled by a digital or analog user interface ("external controls" 146) mounted on the screen frame 125 or window frame.

Figure 9A:
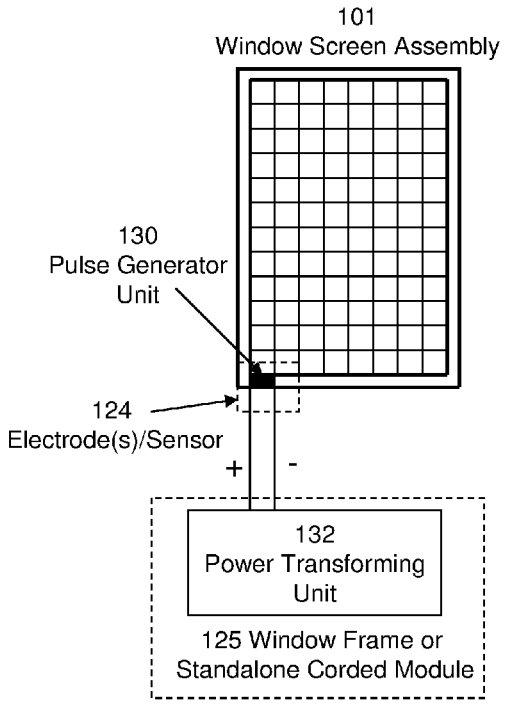
FIG. 9*a* is a plan block diagram of one embodiment of the invention's mounted AC power configuration.

In FIG. 9*a* the power transforming unit 132 is external to the wire screen mesh assembly 101 and supplies the low-voltage (e.g. 12V) DC output to the frame-mounted pulse generator unit 130. The power transforming unit 132 may be either a standalone module that plugs in to a standard building power outlet and is connected to the power transforming unit 132 via an output cord, or the power transforming unit 132 may be mounted within the window frame and connected to the pulse generator unit via electrodes 124 mounted in the window frame 125 (seen in FIG. 10).

Figure 9B:
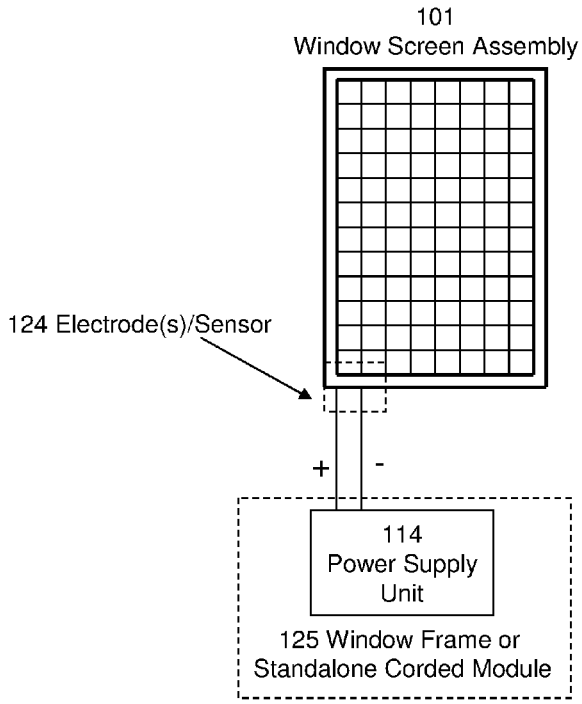
FIG. 9*b* is a plan block diagram of another embodiment of the invention's mounted AC power configuration.

Similarly, as seen in FIG. 9*b*, the entire power supply unit circuitry 114 may be external to the wire mesh screen assembly 101. The power supply unit 114 may be mounted within the window frame and connected to the conductive tracks 118, 120 via electrodes 124 mounted in the window frame 125 (seen in FIG. 10), or the power supply unit 114 may be a standalone corded module that plugs in to a standard building power outlet and is connected to the conductive tracks 118, 120 via an output cord. The hard-wired window frame embodiment is most practical if the power supply unit 114 is being installed during the construction or remodeling of a building. In both of the two preceding configurations, the high-voltage electric pulses are generated externally and transmitted to the conductive tracks 118, 120 via external electrodes.

Figure 10:
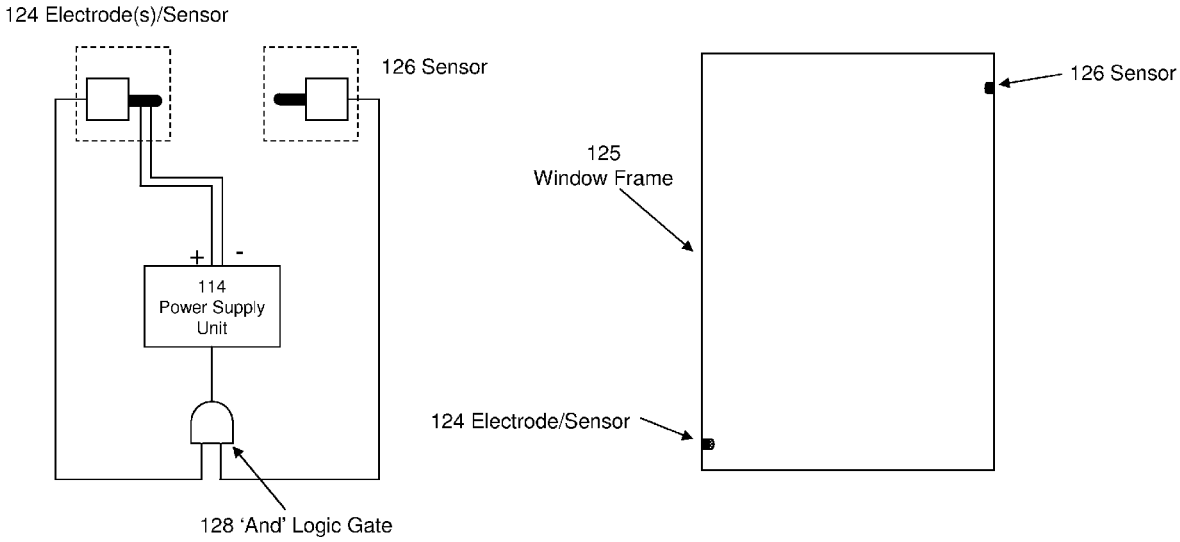
FIG. 10 is a plan block diagram of an electric safety mechanism for the invention.

In the instance of the window frame-mounted AC configuration, there may be sensors 124, 126 installed in the window frame 125 to detect whether the invention is present, properly aligned, and properly secured in the window frame 125 (as seen in FIG. 10). For safety reasons, only when the 'And' logic gate 128 detects the correct positioning of the invention via the window frame-mounted sensors 124, 126 will the window frame 125 electrode(s) 126 be electrified with the output of the window frame-mounted power supply unit 114 or power transformer unit 132.

All of the invention's wiring and electronics casings should be water- and weather-proof. Weather-proofing is accomplished by applying sealant (it may be a petroleum-based sealant such as silicone) to each orifice on the invention that leads to any circuit wiring. The sites of sealant application include the screen wire mounts 122, the electric power leads 115, 117, and any user interface that may be mounted on the screen frame, such as the external controls 146. Waterproofing prevents the invention from being damaged when exposed to outdoor weather elements. Additionally, the screen wires 100 may be externally coated with a non-stick coating such as Teflon. The non-stick coating allows for easily cleaning the screen of trapped particulate. Consequently, cleaning may be accomplished by spraying the invention with water, vacuuming the screen, brushing the screen, etc.

Figure 11:
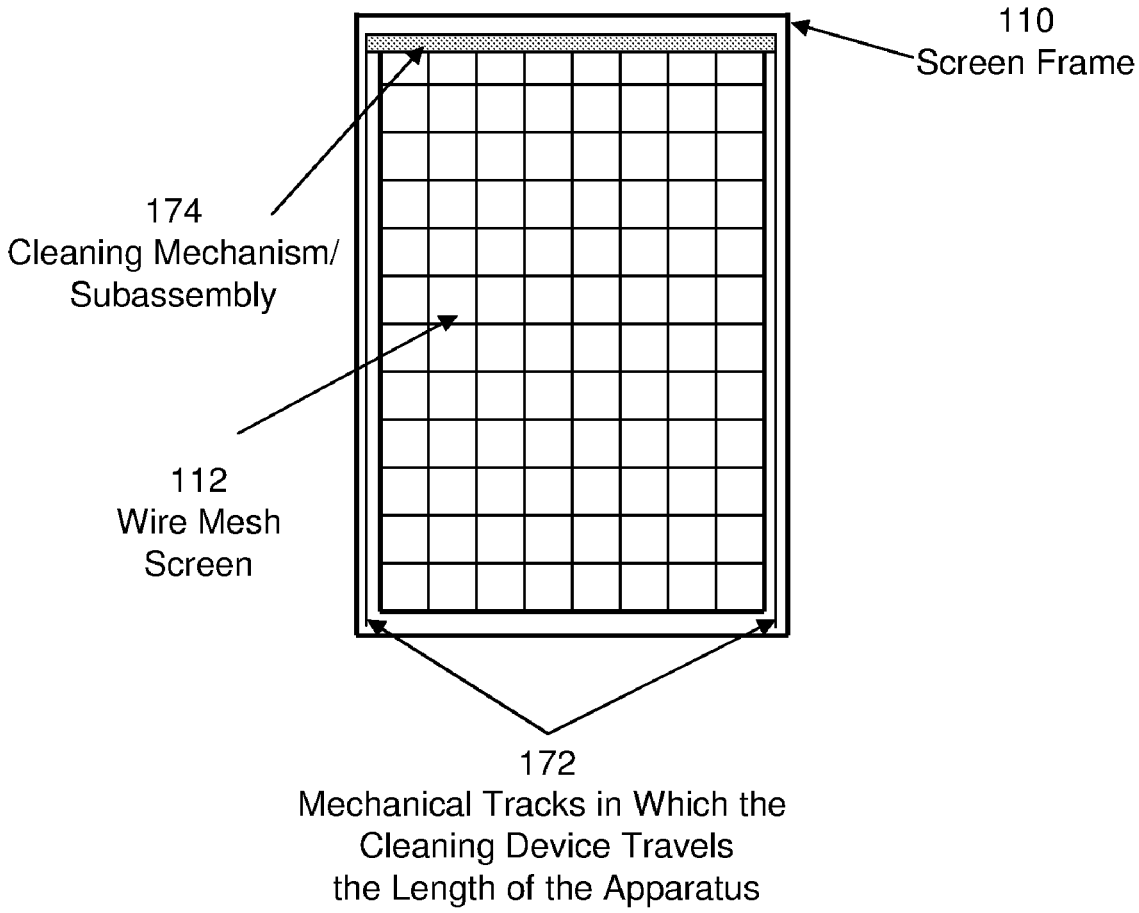
FIG. 11 is a plan perspective of the invention fitted with a cleaning subassembly.

The invention may also have a built-in cleaning apparatus that cleans trapped particulate 170 from the wire mesh screen 112. One embodiment of the cleaning apparatus is a rectangular unit 174 that is mounted to the screen frame 110 on tracks or grooves 172 built in to the vertical/longitudinal sides of the frame, as seen in FIG. 11. The cleaning apparatus contains a motor that moves the apparatus within the frame tracks 171 via a friction device (such as a wheel) or pulley wire. The cleaning apparatus contains a means for removing particulate stuck on the screen mesh 112. Cleaning may be accomplished with a friction device (such as a brush physically dislodging the particulate from the screen mesh) or by moving air streams (by either vacuuming the particulate or blowing the particulate off the screen mesh with a stream of moving air).

While not a preferred embodiment, the screen mesh 112 may be constructed from synthetic fibers that are permanently electrostatically charged; some fibers are charged to a positive electric potential while other fibers are charged to a negative electric potential. In this embodiment, the need for an electric power supply is negated, simplifying the construction and operation of the invention. Such permanently charged fibers are commercially available; one product incorporating such fibers is 3M's Filtrete line of furnace air filters.

What is claimed is:

1. A window screen apparatus that utilizes electrostatic properties to purify the air passing through or in the vicinity of the apparatus comprising:

a. a window screen frame designed to fit and latch into the window frame for which the apparatus is designed to be mounted; and b. a pair of electrically-conductive tracks that run the perimeter of the apparatus frame and are electrically insulated from each other and the apparatus frame, with one track being designated the negative potential track and the other track being designated the positive potential track; and c. a wire mesh screen, consisting of interwoven or cross-hatched wires, mounted to the window screen frame; and d. a power supply unit electrically connected to the tracks that generates high-voltage, low-amperage DC electric pulses; and e. a cleaning mechanism mounted to the window screen frame that cleans the wire mesh screen.

2. The apparatus of claim 1 wherein the wire used to create the screen mesh is made from a strong, flexible, and electrically-insulating material and is coated with a non-stick material and wholly contains within it one electrically conductive filament.

3. The apparatus of claim 2 wherein the filament contained within each screen mesh wire is electrically connected to one of the electrically-conductive tracks running the perimeter of the window screen frame.

4. The apparatus of claim 3 wherein the power supply unit consists of an AC-DC electric converter, a ground fault interrupter, a programmable logic control circuit, and a high-voltage DC pulse generator, connected in series.

5. The apparatus of claim 3 wherein the power supply unit consists of a battery harness, a programmable logic control circuit, and a high-voltage DC pulse generator, connected in series.

6. The apparatus of claims 4 and 5 wherein the high-voltage DC pulse generator with positive and negative output electrodes, with the positive output electrode electrically connected to the positive track and the negative output electrode electrically connected to the negative track.

7. The apparatus of claim 6 wherein the cleaning mechanism is a module mounted to the window screen frame consisting of a self-contained method of locomotion, comprising a motor that drives a friction wheel that propels the module across the plane of the apparatus.

8. The apparatus of claim 7 wherein the cleaning mechanism consists of a friction cleaning device, comprising a brush mounted to an axel that is connected to the mechanism's motor such that the brush is spun across plane of the wire mesh, physically dislodging trapped particulate.

9. The apparatus of claim 7 wherein the cleaning mechanism consists of a fluid compressor that propels a column of high-velocity fluid, across the plane of the wire mesh.

10. A window screen apparatus that utilizes electrostatic properties to purify the air passing through or in the vicinity of the apparatus comprising:

a. a window screen frame designed to fit and latch into the window frame for which the apparatus is designed to be mounted; and b. a wire mesh screen, consisting of interwoven or cross-hatched wires, mounted to the window screen frame; and c. a cleaning mechanism mounted to the window screen frame that cleans the wire mesh screen.

11. The apparatus of claim 10 wherein the wire used to create the screen mesh wholly or partially consists of permanently electrostatically-charged fibers.

12. The apparatus of claim 11 wherein the cleaning mechanism is a module mounted to the window screen frame consisting of a self-contained method of locomotion, comprising a motor that drives a friction wheel that propels the module across the plane of the apparatus.

13. The apparatus of claim 12 wherein the cleaning mechanism consists of a friction cleaning device, comprising a brush mounted to an axel that is connected to the mechanism's motor such that the brush is moved across the plane of the wire mesh, physically dislodging trapped particulate.

14. The apparatus of claim 12 wherein the cleaning mechanism consists of a fluid compressor that propels a column of high-velocity fluid across the plane of the wire mesh.

* * * * *